United States Patent [19]

Stahlecker

[11] Patent Number: 4,472,931

[45] Date of Patent: Sep. 25, 1984

[54] WRAPPED YARN SPINNING MACHINE

[75] Inventor: Fritz Stahlecker, Bad Ueberkingen, Fed. Rep. of Germany

[73] Assignee: Hans Stahlecker, Suessen, Fed. Rep. of Germany; a part interest

[21] Appl. No.: 413,477

[22] Filed: Aug. 31, 1982

[30] Foreign Application Priority Data

Sep. 5, 1981 [DE] Fed. Rep. of Germany ..... 3135270

[51] Int. Cl.[3] ..... D02G 3/36; D01H 11/00

[52] U.S. Cl. ..... 57/18; 57/6; 57/304

[58] Field of Search ..... 57/16–18, 57/6, 304, 305

[56] References Cited

U.S. PATENT DOCUMENTS 3,681,909 8/1972 Korikovsky et al. ..... 57/18 X 4,170,101 10/1979 Bock ..... 57/18 X 4,336,683 6/1982 Bock et al. ..... 57/18

4,348,858 9/1982 Rottmayr ..... 57/18

4,391,089 7/1983 Billner et al. ..... 57/18 X

*Primary Examiner*—John Petrakes

*Attorney, Agent, or Firm*—Craig & Burns

[57] ABSTRACT

A wrapped yarn spinning unit equipped with a delivery device for a sliver, a hollow spindle that carries a binding thread to be wrapped about the sliver and rotating together with the hollow spindle, a take-off device for the wrapped yarn, a feed tube between the delivery device and the hollow spindle and an air line connected to the feed tube at a distance downstream of the inlet opening of the feed tube and adapted to be connected to a vacuum source; a twist-producing device is further provided within the area of the inlet opening of the hollow spindle.

17 Claims, 5 Drawing Figures

WRAPPED YARN SPINNING MACHINE

The present invention relates to a wrapped yarn spinning machine with a feed or delivery device for a sliver to be wrapped by spinning, with a hollow spindle which carries a binding thread rotating with the same and wrapping the sliver, and with a take-off device for the wrapped yarn, in which a feed tube is arranged between the feed or delivery device and the hollow spindle that tapers in the direction toward the hollow spindle and to which is connected an air line.

In a prior art wrapped yarn spinning aggregate of the aforementioned type (German Pat. No. 1,685,881), orifices of compressed air lines are provided within the area of the inlet opening of the feed tube which bridges the distance between the delivery device and the inlet opening of the hollow spindle, which orifices are mutually offset in the circumferential direction and are inclined in the conveying direction of the sliver. A rotating air stream directed toward the outlet opening is to be produced thereby inside of the feed tube, which is to facilitate the insertion of the sliver into the inlet opening of the hollow spindle. The tapering of the feed tube extending in the conveying direction serves the same purpose. With this type of construction, the compressed air is fed-in at the place at which the sliver is practically not yet twisted and held together by a protective twist. It is to be feared with such prior art construction that the fiber orientation will be impaired by the supply of the compressed air and that also contaminations will be supplied together with the compressed air which are then bound into the wrapped yarn. With the known construction, the hollow spindle, as a whole, is additionally constructed as false twist device so that the location where the false twist is imparted is not accurately defined, which leads to an uneven yarn. The false twist distributes itself in this case over a relatively long piece of yarn so that the stronger twists result preferredly in thinned-out places of the yarn, which leads to unevenesses.

The present invention is concerned with the task to so construct a wrapped yarn spinning aggregate of the aforementioned type that a yarn results completely satisfactory from a qualitative point of view, in which, to the greatest possible extent, no dirt, contaminations or impurities are contained. The underlying problems are solved according to the present invention in that the air line is arranged at a distance downstream of the inlet opening of the feed tube and is connected to a vacuum source, and in that the hollow spindle is provided with a twist-producing device within the area of its inlet opening.

As a result of the suction action within the area of the feed tube, there is created the possibility to suck-off contaminants eventually present in the sliver and also the fiber fly or the like so that a cleaning of the sliver is realized prior to the wrapping. Since the suction action takes place at a distance from the inlet opening of the feed tube, the fiber triangle forming at the outlet of the delivery device is not disturbed by the resulting air stream. Additionally, it is assured by the arrangement of the twist-producing device within the area of the inlet opening of the hollow spindle that the sliver is provided with a protective twist already within the area of the suction location so that no fibers are sucked off by the suction device or are even impaired in their position. The false twist is produced at a defined place by the twist-producing device of the present invention so that a relatively short twist distance is obtained which leads to a uniform yarn according to experience.

In an appropriate construction of the present invention, provision is made that the connecting place of the air line at the feed tube is inclined against the conveying direction. An air stream pointing in the conveying direction is obtained thereby which facilitates the introduction of the sliver into the feed tube.

It is particularly appropriate if the connecting place of the air line is provided approximately centrally between the inlet opening and the outlet opening of the feed tube, respectively, of the inlet opening of the hollow spindle arranged in axial extension of the feed tube. This location has proved as particularly favorable since, in that case, the fibers preserve the conveying direction also under the influence of the air flow between the delivery device and the suction place and thus remain in parallel arrangement. The coaxial arrangement of feed tube and hollow spindle also facilitates the passing-through and possibly the threading.

According to a further feature of the present invention, a connecting place of an air line adapted to be connected with a compressed air source is provided at the feed tube, preferably disposed opposite the connecting place of the air line connected to a vacuum source. It is possible as a result of this construction, for example, when first inserting coarse slivers and/or in case of high drafts of the drafting unit (of the feed device) to remove the sliver by way of the suction device without the danger of clogging since the sliver can be blown into the suction line by means of this additional air line.

Provision is made according to still another feature of the present invention that the inlet opening of the feed tube is constructed as a funnel with an oval cross section whose largest diameter is disposed parallel to the clamping line of a feed roller pair of the delivery device. As a result thereof, it is possible to completely surround the thread start, the so-called fiber triangle, by the feed tube without influencing the form.

In order to facilitate the threading of the sliver and/or of piecing thread into the feed tube, provision is made according to still another feature of the present invention that the feed tube is provided with a slot extending over its entire axial length and adapted to be closed off. A threading slot is produced therewith which does not impair the sliver transport nor the suction effect since it is closed in the operating condition.

According to still another feature of the present invention, provision is made that the feed tube, the air line connected to the vacuum source and possibly the air line adapted to be connected to a compressed air source, are machined into a block as fiber feed channel and air channels. A particularly appropriate and effective construction results therefrom which additionally enables a very accurate arrangement and construction of the individual channels. It is thereby particularly advantageous if the block consists of two parts between which is present a separating gap extending over the entire axial length of the feed channel, which gap extends through the feed channel. This separating gap or joint, which is closed in the operating condition, forms the slot utilizable for threading purposes.

According to still another feature of the present invention, provision is also made that the hollow spindle is provided within the area of its inlet opening with at least one cross bore serving as twist-producing device. It is thereby appropriate if the hollow spindle is provided within the area of its inlet opening with two cross bores offset in the conveying direction which—as viewed in the conveying direction—are arranged diametrally to each other. In this manner, a twist producer is created directly downstream of the area of the inlet opening which, on the one hand, assures a defined twist distance and, on the other, is so constructed that the sliver, which is already wrapped with the binding thread and is thus held or fastened together, is guided through the cross bores forming the twist producer.

These and other objects, features and advantages of the present invention will become more apparent from the following description when taken in connection with the accompanying drawing which shows, for purposes of illustration only, two embodiments of a wrapped yarn spinning unit according to the present invention, and wherein.

Figure 1:
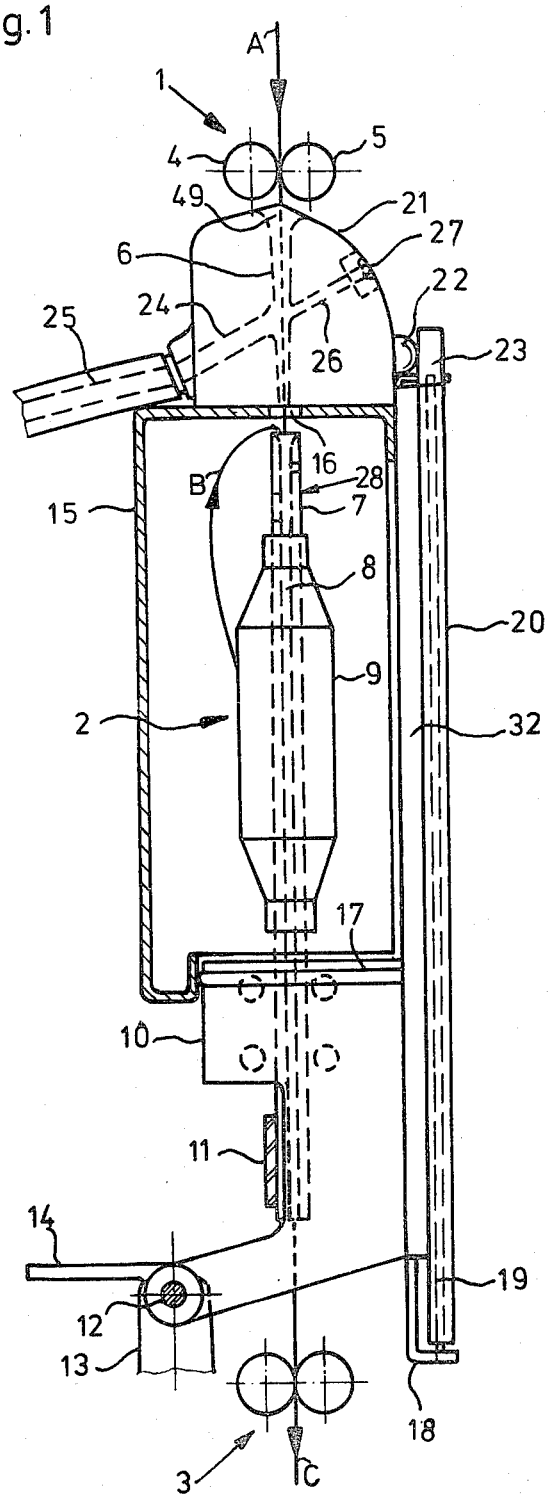
FIG. 1 is a partial vertical cross-sectional view through a wrapped yarn spinning aggregate in accordance with the present invention in the operating position thereof, in which not all parts thereof are shown in cross section.
Figure 2:
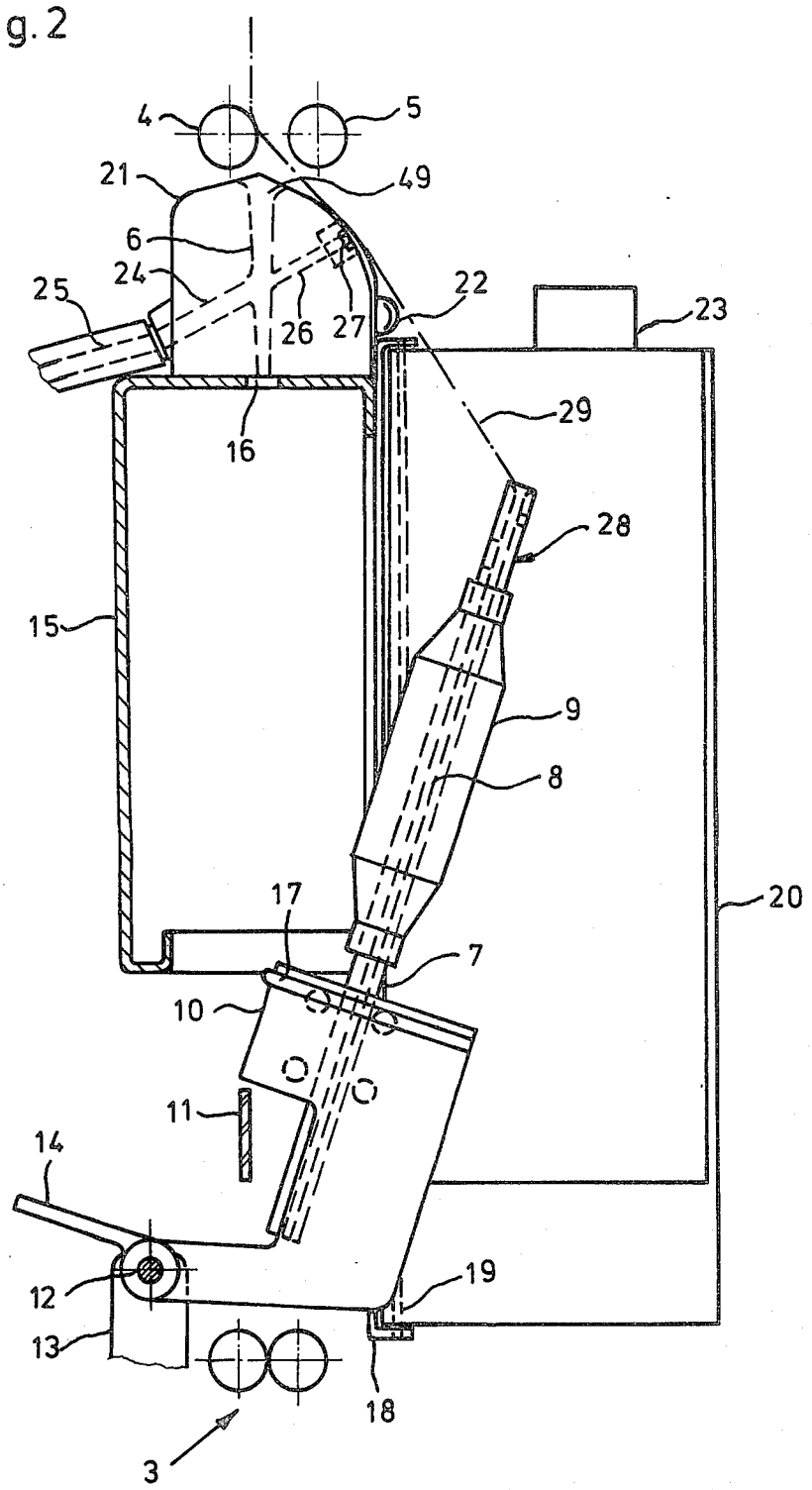
FIG. 2 is a cross-sectional view, similar to FIG. 1, through the wrapped yarn spinning aggregate in the inoperative position thereof.
Figure 4:
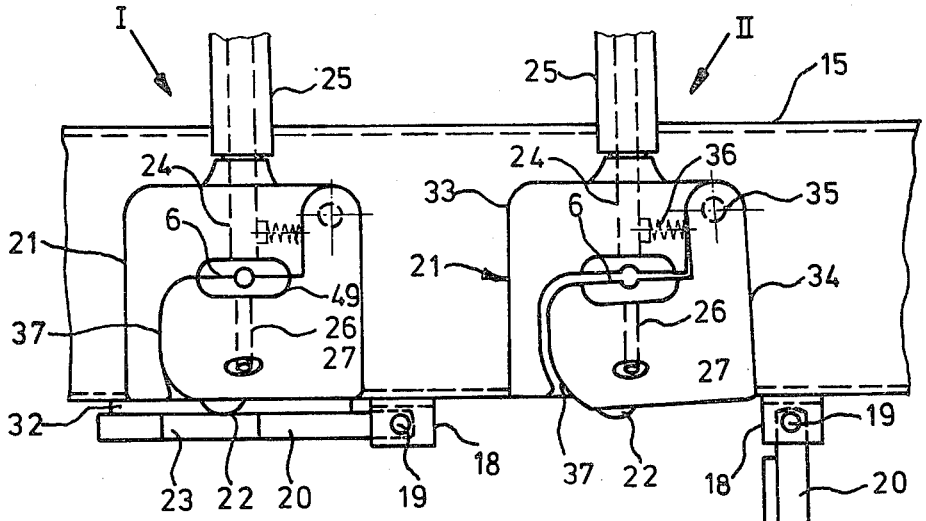
Figure 5:
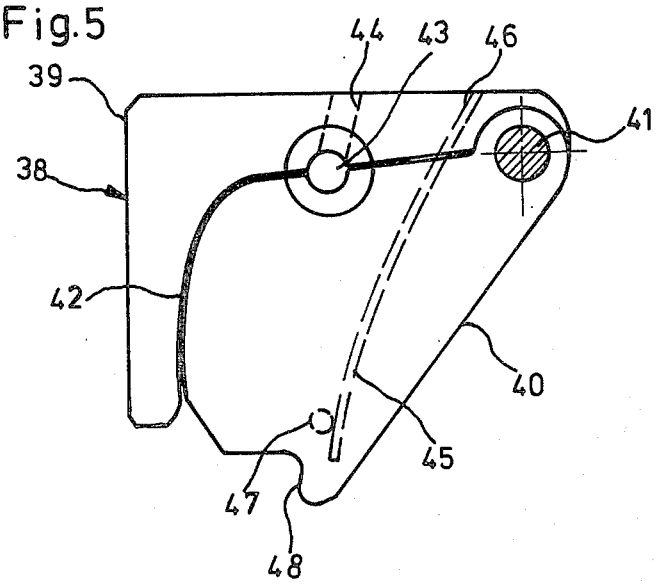

FIG. 4 is a top plan view on two adjacent spinning aggregates corresponding to FIGS. 1 and 2 on a reduced scale, with the delivery devices omitted for the sake of clarity; and FIG. 5 is a top plan view, similar to FIG. 4, on a further embodiment of a feed tube machined into a block, which is arranged between a delivery device and a hollow spindle of a wrapped yarn spinning aggregate in accordance with the present invention.

Referring now to the drawing wherein like reference numerals are used throughout the various views to designate like parts, the wrapped yarn spinning aggregate illustrated in FIG. 1 includes a feed or delivery device generally designated by reference numeral 1 for a staple sliver A to be wrapped, which, as a rule, consists of a drafting unit, of which only the rollers 4 and 5 disposed at the outlet are illustrated in the drawing. The sliver A is wrapped about with a binding thread B within the area of a twist-producing device generally designated by reference numeral 2. The twist-producing device 2 consists of a rotating hollow spindle which includes an axial bore 8 and which carries a binding thread spool 9 rotating in unison therewith. The hollow spindle 7 is supported below the binding thread spool 9 in a bearing housing 10 by means of suitable bearings and is driven within the area of its end projecting out of the bearing housing 10 by a tangential belt 11 which preferably extends over the entire machine and drives all hollow spindles of the wrapped yarn spinning aggregates arranged adjacent one another on one machine side. A take-off device generally designated by reference numeral 3 for the wrapped yarn C follows the hollow spindle 7, which, in turn, is followed by a winding device of any conventional construction on which the wrapped yarn C is wound.

The area of the hollow spindle 7 which carries the binding thread spool 9 is enclosed by a housing 15 that consists of a suitable sheet metal profile which is closed off at each spinning aggregate on the operating side by a lid 20. The housings 15 of the spinning aggregates of one machine side form a continuous channel extending uninterruptedly in the longitudinal direction of the machine. This channel is composed of several components of the housing 15 that extend, respectively, over a predetermined number of spinning aggregates. The bearing housings 10, which are provided with a sealing profile 17, are sealingly fitted into the bottom of the housing 15. The lids 20 sealingly close off the operating side of the housings 15 of the spinning aggregates. For that purpose, they are equipped internally with a layer 32 of foamed material or the like which abuts sealingly against the front side of the housings 15. The lids 20, which are each pivotally arranged about a vertical pivot shaft 19 arranged in a support 18, completely cover the housings 15 over their full height and also the bearing housings 10 of the individual spinning aggregates.

The bearing housings 10 are pivotal about pivot shafts 12 fixedly arranged at the machine frame 13 and extending in the longitudinal direction of the machine. They include an actuating arm 14, at which engages an automatic actuating device not illustrated in detail which may be controlled, for example, by a conventional broken-end detector arranged downstream of the take-off device 3 and which responds in case of a broken end and pivots the bearing housings 10 together with the hollow spindles 7 into the inoperative position (FIG. 2) in case of a broken end. Since such automatic actuating mechanisms are known in the art and form no part of the present invention, a detailed description thereof is dispensed with herein. Transmission elements of any conventional construction and therefore not illustrated in detail herein are arranged between the bearing housings 10 and the lids 20, which open the respective lid 20 during a pivoting-out of the corresponding bearing housing 10 into the position illustrated in FIG. 2, in which the hollow spindle 7 is also separated from the tangential belt 11.

Figure 3:
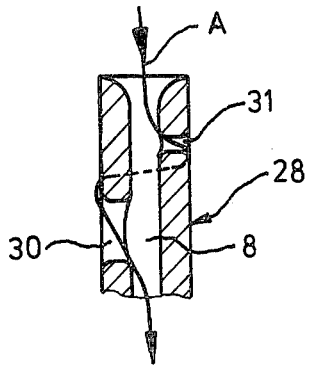
FIG. 3 is a cross-sectional view, on an enlarged scale, of a twist producer according to the present invention, integrated into the inlet area of a hollow spindle.

A sliver feed channel 6 is provided between the hollow spindle 7 and the rollers 4 and 5 of the delivery device 1 which, in the operating position, extends in axial extension with respect to the axial bore 8 of the hollow spindle 7. Within the area of the outlet opening of this sliver feed channel 6, the top side of the housing is provided with an opening 16. The sliver feed channel 6 which is extended closely up to the rollers 4 and 5, tapers in the conveying direction of the sliver A continuously up to the inlet opening of the hollow spindle 7. The end of the sliver feed channel 6 facing the rollers 4 and 5 is constructed as a funnel-shaped inlet opening 49 of oval cross section whose largest diameter extends parallel to the clamping gap formed between the two rollers 4 and 5. At least within the area of this inlet opening 49, the block containing the sliver feed channel 6 is constructed wedge-shaped so that it projects far into the area between the rollers 4 and 5 so that the sliver feed channel 6 is able to securely receive and protect the incoming sliver A also especially within the area of the fiber triangle. An air line 24 is connected to the fiber feed channel 6 which is connected by way of a vacuum line 25 with a conventional vacuum source, for example, with a suction blower of the machine. The connection of the line 24 takes place at the fiber feed channel 6 approximately centrally between the inlet opening 49 of the fiber feed channel 6 and the inlet opening of the hollow spindle 7. The connection of the line 24 is thereby so inclined to the axial direction of the sliver feed channel 6 that an air stream results in the tapering inlet area that is directed in the conveying direction. The inlet area of the hollow spindle 7 is provided with a twist-producing device generally designated by reference numeral 28 (FIG. 3) so that an accurately defined twist zone is created in the sliver within the inlet area of the hollow spindle 7. The connection of the line 24 to the sliver feed channel 6 is so selected that within this area, on the one hand, the sliver A still forms a relatively loose association yet, on the other hand, a certain protective twist is present which is produced by the hollow spindle 7. It becomes possible thereby that contaminants can be sucked off out of the sliver A without at the same time sucking-off fibers or disturbing the fiber arrangement inside of the sliver A. It is therefore important that a defined protective twist is present within the area of the suction, i.e., within the area of the connection of the line 24 to the sliver feed channel 6.

Under certain operating conditions, for example, during the spinning start, it may be appropriate if the entire fed sliver A is sucked-off by way of the line 24. In order to facilitate this and to make it realizable without clogging, a further line 26 is connected to the sliver feed channel 6 in axial extension to the line 24, which further line 26 is closed off by a valve 27. A compressed air line, for example, a compressed air pistol, may be connected to this line 26, respectively, to the valve 27, by means of which the air stream to the line 24 is reinforced so that a removal is possible without the danger of clogging.

The twist-producing device 28 (FIG. 3) provided within the inlet area of the hollow spindle 7 consists of two cross bores 30 and 31 through which are guided the sliver A and the binding thread B. The sliver A together with the binding thread B enters into the rounded-off, funnel-shaped inlet opening to the axial bore 8 of the hollow spindle 7 and is then guided out of the hollow spindle 7 by way of the cross bore 31 having a relatively small cross section. After a loop angle of 180°, the sliver A together with the binding thread B again enters the axial bore 8 of the hollow spindle 7 by way of the cross bore 30 having a considerably larger cross section. The two cross bores 30 and 31 which—as viewed in the axial direction—are diametrally offset in height with respect to each other, possess well rounded-off rims.

In order to facilitate the introduction of the sliver A, respectively, of a piecing yarn 29 (FIG. 2), the block 21 is provided with a slot 37 extending over the entire axial length of the fiber feed channel 6, which serves as threading slot (FIG. 4). The top side of the housing 15 is provided with a recess corresponding to the slot 37. The block 21 consists of the two parts 33 and 34 of which one part, namely the part 33 provided with the line 24 is mounted fixedly on the top side of the housing 15. The other part 34 is pivotally mounted at the first part 33 about a pivot shaft 35 which extends parallel to the axis of the sliver feed channel 6. This part 34 thereby slides on the top side of the housing 15 so that a closure is obtained which seals with respect to the housing 15. The two parts 33 and 34 have a separating joint or separating gap which forms the slot 37 and which extends through the sliver feed channel 6. In the operating position, the two parts 33 and 34 abut sealingly at one another within the area of the separating joint or gap so that the slot 37 is closed off. In the inoperative position, this slot 37 is opened, for which purpose in the embodiment according to FIG. 4, a spring engages the part 34 which pivots this part 34 into the opened position, in which the slot 37 (FIG. 4, right half) is exposed. A bracket 23 is mounted on the lid 20 while a ball head 22 of the part 34 is disposed opposite the bracket 23 so that during the closing, the lid 20 forces the part 34 into the closed position (FIG. 4, left half). The side of the parts 33 and 34 facing the lid 20 is rounded off convexly so that it forms a surface over which the piecing thread 29, respectively, the sliver A, can slide easily during the spinning start before they are introduced into the sliver feed channel 6 by way of the slot 37. The roller 5 may be lifted off from the roller 4 (FIG. 2) for the purpose of facilitated insertion of the piecing thread 29.

A further embodiment of a block generally designated by reference numeral 38 is illustrated in FIG. 5, which contains a sliver feed channel 43, to which is connected an air line 44 leading to a vacuum source of the spinning machine. The block 38 consists of two parts 39 and 40 which are connected with each other by a pivot shaft 41 extending parallel to the sliver feed channel 43. A separating joint or gap 42 extending through the sliver feed channel 43 is provided between the two parts 39 and 40, which extends over the entire axial length of the sliver feed channel 43 and which is opened for achieving a threading slot. In this embodiment, a leaf spring 45 is arranged between the two parts 39 and 40 which stresses the two parts 39 and 40 into their closed position. The leaf spring 45 is clamped-in with its end 46 into the fixedly arranged part 39 and supports itself within the area of its other end at an entrainment bolt 47 of the part 40. Especially with a relatively coarse yarn number, the piecing thread, respectively, sliver, can thread itself automatically into the sliver feed channel 43 during the spinning start in that the piecing thread, respectively, sliver, spreads apart the two parts 39 and 40 against the force of the leaf spring 45. However, a spreading-apart can also be realized, for example, manually for which purpose an actuating cam 48 is provided at the part 40.

As a result of the combination of a twist producer 28 within the inlet area of the hollow spindle 7 and the arrangement of a sliver feed tube 6, 43 with suction by way of a line 24 respectively 44, a wrapped yarn of particular uniformity can be produced which is far-reachingly free of dirt or other contaminations. It is thereby important that a protective twist of predetermined magnitude is present within the area of the lines 24 and 44 which, on the one hand, enables a sucking-off of contaminants out of the loose fiber association, yet on the other hand, securely holds together the fibers in the fiber formation so that a sucking-off of the fibers is prevented with certainty. As a result of the two-partite construction of the blocks 21 and 38, a facilitated insertion of a sliver or of a piecing thread is assured therebeyond since a threading slot is created between the two parts 33 and 34, respectively, 39 and 40.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A wrapped yarn spinning aggregate comprising delivery means for a sliver to be spin-wrapped, hollow spindle means having an inlet opening and carrying a binding thread to be wrapped about the sliver and rotating with the hollow spindle means, take-off means for the wrapped yarn, and feed tube means having inlet and outlet openings and arranged between the delivery means and the hollow spindle means, said feed tube means tapering in the direction toward the hollow spindle means, and an air line means operatively connected to said feed tube means, the air line means being arranged at a distance downstream of the inlet opening of the feed tube means and being operatively connected to a vacuum source, and in that the hollow spindle means is provided with a twist-producing means within the area of its inlet opening, the feed tube means being provided with slot means extending over the entire axial length thereof and operable to be closed, the feed tube means and the air line means being machined into a block as fiber feed and air channels, the feed tube means forming a feed channel, and the block consisting of two parts, a separating joint extending over the entire axial length of the feed channel being formed between the two parts of the block and extending across the feed channel.

2. A spinning aggregate according to claim 1, characterized in that one part of the block is fixedly arranged and that the other part of the block is movably arranged for purposes of opening of the separating joint.

3. A spinning aggregate according to claim 2, characterized in that said one part is the part provided with the air line means connected to the vacuum source.

4. A spinning aggregate according to claim 2, characterized in that the two parts of the block are connected with each other by way of a pivot shaft extending substantially parallel to the longitudinal axis of the feed channel.

5. A spinning aggregate according to claim 4, characterized in that a closing means is provided for the movable part of the block which holds the movable part in the closed position against the action of a spring.

6. A spinning aggregate according to claim 2, characterized in that the movable part of the block is retained in the closing position by a spring means.

7. A spinning aggregate according to claim 2, characterized in that the hollow spindle means is provided within the area of its inlet opening with at least one cross bore serving as twist-producing means.

8. A spinning aggregate according to claim 7, characterized in that the hollow spindle means is provided within the area of its inlet opening with two cross bores offset in the transport direction which are arranged diametrally to each other—as viewed in the transport direction.

9. A wrapped yarn spinning aggregate comprising delivery means for a sliver to be spin-wrapped, hollow spindle means having an inlet opening and carrying a binding thread to be wrapped about the sliver and rotating with the hollow spindle means, take-off means for the wrapped yarn, and feed tube means having inlet and outlet openings and arranged between the delivery means and the hollow spindle means, said feed tube means tapering in the direction toward the hollow spindle means, and an air line means operatively connected to said feed tube means, the air line means being arranged at a distance downstream of the inlet opening of the feed tube means and being operatively connected to a vacuum source, and in that the hollow spindle means is provided with a twist-producing means within the area of its inlet opening, the location of the connection of the air line means being approximately centrally between the inlet opening and outlet opening of the feed tube means, and a further connection provided at the feed tube means for another air line means adapted to be connected with a source of compressed air.

10. A wrapped yarn spinning aggregate comprising delivery means for a sliver to be spin-wrapped, hollow spindle means having an inlet opening and carrying a binding thread to be wrapped about the sliver and rotating with the hollow spindle means, take-off means for the wrapped yarn, and feed tube means having inlet and outlet openings and arranged between the delivery means and the hollow spindle means, said feed tube means tapering in the direction toward the hollow spindle means, and an air line means operatively connected to said feed tube means, the air line means being arranged at a distance downstream of the inlet opening of the feed tube means and being operatively connected to a vacuum source, and in that the hollow spindle means is provided with a twist-producing means within the area of its inlet opening, the feed tube means being provided with slot means extending over the entire axial length thereof, and further means for closing said slot means during operation.

11. A wrapped-yarn spinning aggregate comprising delivery means for a sliver to be spin-wrapped, hollow spindle means having an inlet opening and carrying a binding thread to be wrapped about the sliver and rotating with the hollow spindle means, take-off means for the wrapped yarn, and feed tube means having inlet and outlet openings and arranged between the delivery means and the hollow spindle means, said feed tube means tapering in the direction toward the hollow spindle means, and an air line means operatively connected to said feed tube means, the air line means being arranged at a distance downstream of the inlet opening of the feed tube means and being operatively connected to a vacuum source, and in that the hollow spindle means is provided with a twist-producing means within the area of its inlet opening, and a further connection provided at the feed tube means for another air line means adapted to be connected with a source of compressed air.

12. A spinning aggregate according to claim 9, characterized in that the last-mentioned air line means is arranged substantially opposite the connecting place of the air line means connected to the vacuum source.

13. A spinning aggregate with a hollow spindle means having an inlet opening according to claim 12, characterized in that the connecting place of the air line means is located approximately centrally between the inlet opening of the feed tube means and inlet opening of the hollow spindle means arranged in substantially axial extension of the feed tube means.

14. A spinning aggregate according to claim 13, characterized in that the location of the connection of the air line means is inclined with respect to the conveying direction of the feed tube means.

15. A spinning aggregate according to claim 12, characterized in that the inlet opening of the feed tube means is constructed as a funnel with an oval cross section whose largest diameter extends substantially parallel to a clamping line of a feed roller pair of the delivery means.

16. A spinning aggregate according to claim 11, wherein the another air line means is arranged substantially opposite the connecting place of the first-mentioned air line means.

17. A spinning aggregate according to claim 16, wherein said another air line means is arranged in substantial coaxial extension to said first-mentioned air line means.

* * * * *